United States Patent [19]

Toth

[11] 4,367,666

[45] Jan. 11, 1983

[54] TICKET STOCK FEED AND SHEAR SYSTEM

[75] Inventor: John E. Toth, San Diego, Calif.

[73] Assignee: Cubic Western Data, San Diego, Calif.

[21] Appl. No.: 211,028

[22] Filed: Dec. 1, 1980

[51] Int. Cl.[3] ..... B26D 5/28

[52] U.S. Cl. ..... 83/203; 83/210; 83/251; 83/272; 83/444; 83/650; 242/75

[58] Field of Search ..... 83/272, 203, 205, 649, 83/650, 610–612, 443, 444, 175, 209–211, 251; 242/75, 71.9, 107

[56] References Cited

U.S. PATENT DOCUMENTS

| | | | |
|---|---|---|---|
| 1,937,918 | 12/1933 | Smith et al. | 242/71.9 |
| 2,023,502 | 12/1935 | Armstrong | 242/75 |
| 2,127,772 | 8/1938 | Horn et al. | 242/71.9 |
| 2,734,571 | 2/1956 | Martell | 83/210 |
| 3,245,297 | 4/1966 | Small | 83/272 X |
| 3,474,692 | 10/1969 | Sames | 83/272 X |
| 3,616,718 | 11/1971 | Di Giulo et al. | 83/210 |
| 3,710,664 | 1/1973 | Eveland | 83/205 X |
| 3,885,482 | 5/1975 | Denzin | 83/902 X |
| 4,117,988 | 10/1978 | Moore | 242/71.9 |

*Primary Examiner*—James M. Meister

*Attorney, Agent, or Firm*—Brown & Martin

[57] ABSTRACT

A stock feed and shear system which may be utilized in an automatic ticket vending machine for cutting tickets from different rolls of stock and delivering the tickets to other components such as a printer and a magnetic encoding transport. The rolls are supported on reels having releasable clamp mechanisms for allowing rapid replacement of spent reels while providing a predetermined drag between the roll cores and the reels. The reels are spring loaded so that stock can be unwound from the rolls only by positively driving the same with selectively driven pinch rollers. Guide tracks direct the stock to a rotary shear which cuts single ticket lengths from the stock without metal to metal contact, thereby achieving excellent service life. Sensors provide an indication of spent rolls, completion of a cutting operation, and presence of a ticket in the shear. In another embodiment paper or plastic tickets are pre-cut by a two-way rotary shear and are held in escrow. Thereafter either type of ticket may be selectively driven past a print head by a special drive connection to a single motor. A replacement ticket is cut and held in escrow, thereby eliminating feeding and cutting time in the ticket dispensing operation.

2 Claims, 15 Drawing Figures

TICKET STOCK FEED AND SHEAR SYSTEM

CROSS-REFERENCE TO RELATED APPLICATIONS

This application is related to the following copending U.S. patent applications filed on Dec. 1, 1980.

"Stepper Motor Control Circuit" Ser. No. 211,026 (inventor: Charles L. Hayman);

"Modularized Ticket Handling System For Use in Automatic Ticket Preparation System" Ser. No. 211,022 (inventors: John B. Roes, Guy M. Kelly, Robert F. Case and Chandler R. Deming);

"Modularized Ticket Handling System for Use in Automatic Ticket Processing System" Ser. No. 211,021. (inventors: John B. Roes, Guy M. Kelly, Robert F. Case and Chandler R. Deming);

"Ticket Metering and Throat Barrier Module" Ser. No. 211,030 (inventor: Darrell V. Howerton);

"Ticket Diverter Module" Ser. No. 211,029 (inventors: Gregory E. Miller and John E. Toth);

"Thermal Printing System" Ser. No. 211,025 (inventors: John E. Toth, Wayne M. Spani, Chandler R. Deming, and Anthony W. Cumo);

"Static Diverter Module" Ser. No. 211,024 (inventor: Gregory E. Miller);

"Ticket Exit Drive Module" Ser. No. 211,027 (inventor: Gregory E. Miller); and

"Ticket Transport" Ser. No. 211,023 (inventors: Charles L. Hayman, John B. Roes and Royal C. Moore, Jr.)

BACKGROUND OF THE INVENTION

The present invention relates to automatic fare collection equipment for mass transit systems, and more particularly to a stock feed and shear system for an automatic ticket vending machine.

Mass transit systems now use tickets that are coded for fare collection for a number of trips. Thus, multiple fare payments for rides on trains, subways, buses and the like may be handled by the purchase of one ticket from a vending machine. This avoids the necessity of individual money transactions with each ride, greatly reduces the number of clerks and other personnel required, reduces robbery problems, and eases time delays in moving passengers onto and off of the conveyances.

Such systems, however, require that tickets be processed and reprocessed for individual fare determination and collection from the composite amount of fare paid on each ticket. This requires ticket handling mechanisms that vend tickets, receive tickets, process tickets for admittance to one or more fares, deduct fares from tickets, and return tickets to the user.

The issuing of such tickets and the encoding of the information thereon, which may be magnetically written in binary form, requires a ticket vending machine that is capable of quickly and efficiently preparing tickets. Such a vending machine requires a means for feeding continuous ticket stock on demand and a means for cutting the stock into single ticket lengths.

SUMMARY OF THE INVENTION

It is therefore the primary object of the present invention to provide a stock feed and shear system for an automatic ticket vending machine.

It is another object of the present invention to provide a stock feed and shear system which can operate reliably on an intermittent basis over long periods of time.

It is still a further object of the present invention to provide a stock feed and shear system adapted for cutting and delivering tickets from different types of ticket stock on demand.

It is yet another object of the present invention to provide a novel spring loaded ticket reel for carrying a roll of ticket stock so that only ticket stock positively driven from the roll will be fed to a shear.

It is yet another object of the present invention to provide a system for cutting continuous ticket stock into single ticket lengths which utilizing a rotary shear which avoids blade to blade contact and thereby achieves excellent service life.

It is still a further object of the present invention to provide a stock feed and shear system for an automatic ticket vending machine which will pre-cut paper or plastic tickets and hold them in escrow, all deliver either type of ticket on demand, and immediately thereafter will cut a replacement ticket in order to eliminate delays in the ticket vending process which would otherwise result from the time required to feed stock to the shear.

The present invention provides a stock feed and shear system adapted for cutting and delivering tickets from different rolls of stock on demand as a component of an automatic ticket vending machine. The system may include a pair of reels, each for carrying a roll of stock having a free end. Each of the reels may include a mechanism for releasably clamping a core portion of a roll to allow rapid replacement of spent rolls while providing a predetermined amount of drag which impedes relative rotation between the reel and the roll. A pair of ticket guide tracks direct the free ends of the rolls from the reels to a shear. A photodiode/photosensor combination is provided for detecting the presence of ticket stock in each of the guide tracks to thereby provide an indication of whether a roll is spent.

The shear includes a rotary blade and an opposing fixed blade defining a path therebetween for the stock. Each of the reels is spring loaded to provide a predetermined amount of rewind rotational bias. Pairs of powered pinch rolls for each of the ticket guide tracks may be selectively actuated to unwind stock from corresponding ones of the rolls. As stock unwinds from a roll, the reel carrying the roll is rotated slightly with the roll, until the force of the reverse bias on the reel is greater than the force required to overcome the friction between the core of the roll and the releasable clamping mechanism. When this occurs, the roll slips back.

The rotary blade of the shear has a crank connected to one end thereof. An eccentric mounted on the shaft of a motor is connected to the crank by an arm. Preferably, the throw of the arm is such that during one revolution of the eccentric the rotary blade reciprocates through an angle just large enough so that a ticket will be cut from the stock. The shear is capable of cutting ticket stock without metal to metal contact, thereby achieving excellent service life. A photodiode/photosensor combination senses rotation of the eccentric to determine when the cutting operation is completed. A photodiode/photosensor combination is also utilized in the shear to detect the presence of a ticket therein.

Also provided is a combined shear and printer assembly. When utilized in place of the simpler version of the shear, the resulting stock feed and shear system will pre-cut paper or plastic tickets and hold them in escrow, and will deliver either type of ticket immediately upon demand. Thereafter, the system will cut a replacement ticket and move it into escrow in order to eliminate delays in the ticket vending process which would otherwise result from the time required to feed stock to the shear. This form of the invention utilizes a two-way rotary blade. A pair of fixed shear blades are mounted on opposite sides of the rotary blade to define two paths for stock from different ones of the rolls. Tickets may be cut by this rotary blade by reciprocating back and forth across the adjacent end of the appropriate ticket guide track. Tickets thus cut are held in respective upper and lower ticket channels defined by a dual shear track assembly. These ticket channels feed into a common printer ticket channel through which a ticket may be propelled past a print head.

Upper and lower drive rollers are provided in the combined shear and printer assembly for engaging and propelling tickets from respective ones of the upper and lower ticket channels aft of the rotary blade. A printer drive roller is provided for propelling a ticket through the printer channel past the print head. The various drive rollers are mounted with one-way needle bearings and are drivingly connected via belts and gear trains to the shaft of a common motor. Energization of the motor in one direction will cause a ticket in the upper ticket channel to be propelled away from the rotary blade, and past the print head while the ticket in the lower channel remains stationary. Energization of the motor in the other direction will cause a ticket in the lower channel to be propelled away from the rotary blade, past the print head, while a ticket in the upper channel remains stationary. Upon ejection of a ticket from either of the upper or lower ticket channels, a replacement ticket can immediately be cut from the stock and held in escrow so that two types of tickets are immediately available on demand.

BRIEF DESCRIPTION OF THE DRAWINGS

Throughout the figures like reference numerals refer to like parts unless otherwise indicated.

DESCRIPTION OF THE PREFERRED EMBODIMENTS

Figure 1:
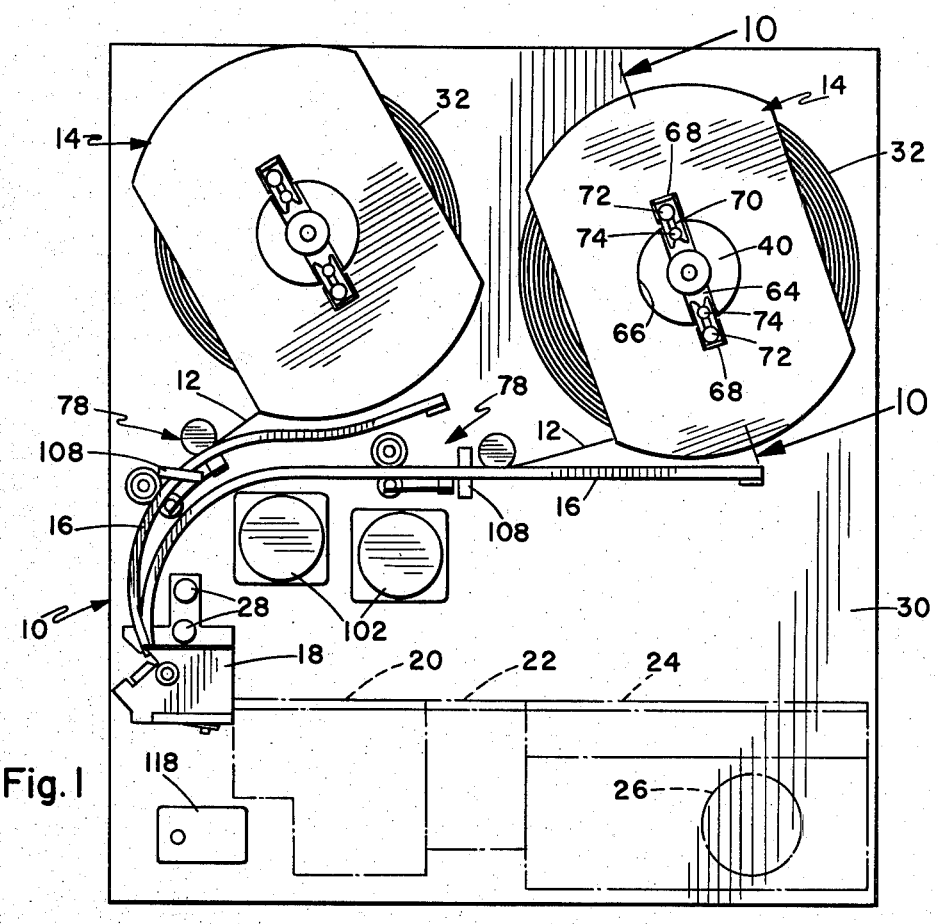
FIG. 1 is a side elevation view of a ticket vending machine incorporating a first embodiment of the ticket stock feed and shear system of the present invention.

Referring to FIG. 1, there is illustrated therein in simplified form an automatic ticket vending machine 10 which incorporates a first embodiment of the ticket stock feed and shear system of the present invention. In the vending machine 10, continuous ticket stock 12 is advanced from one of a pair of reels 14 along one of a pair of guide tracks 16 into a shear 18 which cuts off a single ticket length from the stock. This ticket is advanced to the right in FIG. 1 through a thermal printer module 20 at slow speed, for example 3 inches per second, by a reversible AC motor. Alphanumeric information is rapidly printed on a coating of thermally sensitive material on one side of the ticket. The ticket is then propelled to the right through a static diverter module 22 into a ticket transport 24. The ticket transport includes a motor 26 which is preferably a DC stepper motor controlled by special circuitry for rapidly reciprocating the ticket past a single magnetic head. The ticket may have a strip or facing of magnetic material on one side thereof so that binary information representative of a cumulative fare can be encoded onto and read from the ticket.

The circuitry which controls the motor 26 may rapidly move the ticket within the transport 24 first to the right, then back to the left, and then back to the right again. This allows a single magnetic head in the transport to write, read and verify information on the ticket. If the information is properly verified, the ticket is dispensed to the right through an exit bezel (not illustrated) to the purchaser. If the information magnetically printed on the ticket fails the verification step, the ticket is driven to the left by the transport, back into the static diverter module 22 from which it exits downwardly into a bin (not illustrated) containing defective tickets.

It should be pointed out that the foregoing write, read and verify steps on successive passes by the magnetic head in the transport is not the only manner in which the transport 24 may operate. For example, the ticket may be propelled to the right past the magnetic head during which a write signal may be applied to the head to encode information thereon. Thereafter, the ticket may be reversed and propelled back past the head so that the head may read the information encoded thereon. The read signal may then be compared to the write signal to verify that the information has been properly encoded. If the verification step fails, the ticket may be propelled back to the right again past the head at which time the same information can again be written onto the ticket. The ticket can then be reversed and propelled past the head once again for another verification. This process can be repeated a predetermined number of times until the verification step is successfully completed at which time the ticket may be propelled back to the right again and out the exit bezel to the purchaser. Preferably, if after two or three passes the information is not correctly encoded onto the ticket, then the ticket is reversed so that it can be discarded through the static diverter 22. Another ticket will then take its place. This prevents a purchaser from waiting an undue amount of time.

A more detailed description of the thermal printer module 20 and its drive circuitry, the static diverter module 22, the transport 24, and the special circuitry which controls the motor 26 of the transport, together with a description of the overall operation of the ticket vending machine 10 may be found in the appropriately entitled co-pending U.S. Patent Applications referenced above which are being filed on even date herewith. Where necessary to complete the disclosure of the present invention, the disclosures of the aforementioned related U.S. Patent Applications are specifically incorporated herein by reference.

Preferably, the shear 18, the thermal printer module 20, the static diverter module 22, and the ticket transport 24 are provided with mechanisms such as captive screws 28 for permitting these components to be rapidly mounted to, and detached from, a larger vertical support plate 30. That plate supports the various modules in the adjacent relationship required for operation. The plate 30 also supports the ticket reels 14 and the guide tracks 16.

Figure 10:
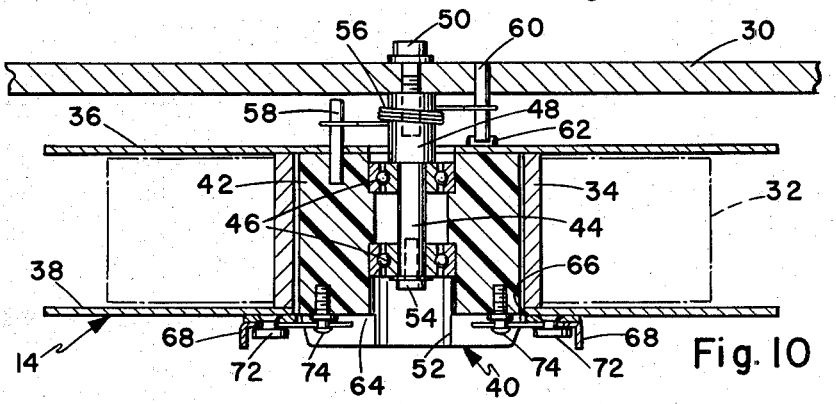
FIG. 10 is an enlarged, rotated sectional view of one of the ticket reels of the vending machine of FIG. 1 taken along line 10—10 of FIG. 1.

The reels 14 carry rolls 32 (FIG. 1) of ticket stock, each consisting of a long continuous strip of suitable material such as paper or plastic wound about a cardboard core 34 (FIG. 10). Ticket stock is selectively driven from one of the reels through one of the guide tracks 16 (FIG. 1) which extend between the reels and the shear 18. The ticket reels are spring loaded so that only the driven stock enters the shear. After the shear cuts off a ticket size length of the stock, the stock is slightly pulled back out of the way by the spring loaded reel so that the ticket stock ends of either of the rolls 32 are then in a position to be selectively driven into the shear on demand.

Each of the reels 14 (FIG. 1) is spring loaded to provide a predetermined amount of counter-clockwise rotational bias. The rolls of ticket stock can be rotated in a clockwise direction only when a pair of pinch rolls are operated to pull the ticket stock from the roll. As will become more apparent hereafter, when ticket stock is pulled from a roll, the reel is rotated slightly clockwise until the force of the reverse bias on the reel provided by a clock-spring mechanism is greater than the force required to overcome the friction between the ticket stock roll and the reel. When this occurs, the roll slips clockwise relative to the reel. When a ticket sized length is cut from the ticket stock by the shear and the powered pinch rolls are reversed momentarily, the spring mechanism causes the reel to kick back counter-clockwise a slight amount thereby taking up the slack in the stock between the reel and the pinch rolls. Thus, the reel does not even rotate through a full revolution but instead reciprocates back and forth.

Referring to FIG. 10, each ticket reel 14 includes an inner plate 36 and an outer plate 38 between which a roll 32 of ticket stock is sandwiched. The inner and outer plates 36 and 38 may have an identical configuration. As illustrated in FIG. 1, each plate of the reels comprises a larger planer sheet metal disc having portions cut away which define parallel chords. Each reel 14 further includes a hub 40 which extends axially between and carries the plates 36 and 38. The hub includes a cylindrical body 42 preferably made of a strong plastic material having a low coefficient of friction. The hub has an outside diameter slightly smaller than the inside diameter of the cardboard core 34 of the roll 32. The body 42 is mounted on the outer end of a shaft 44 with ball bearings 46. The inner end of the shaft 44 is rigidly mounted in the outer end of a support sleeve 48 whose inner end is rigidly secured to the common vertical support plate 30 by a bolt 50 which extends through the plate. The ball bearings 46 are rigidly and firmly mounted in corresponding annular recesses formed in the central bore 52 of the hub 40. The hub is thus held in position on the shaft 44 by the support sleeve 48 at one end and by the head of a retaining bolt 54 screwed into the outer end of the shaft.

Encircling the support sleeve 48 (FIG. 10) is a clock spring 56 having one end looped around a pin 58 rigidly mounted in the hub 40 and having another end looped around a pin 60 rigidly mounted in the common support plate 30. The inner plate 36 of the reel 14 is rigidly secured to the hub 40 by a plurality of screws such as 62 which are located at circumferentially spaced points. The pin 60 is long enough to engage the heads of the screws 62. Rotation of the reel relative to the fixed shaft 44 is thus limited to some predetermined fraction of 360 degrees such as 45 degrees, for example.

The outer end of the hub 40 has a diametrically extending recess 64 (FIGS. 1 and 10) formed therein. The outer plate 38 has a large hole 66 (FIG. 1) in its center which exposes the outer end of the hub 40. A pair of slide type locks 68 are mounted on either side of the outer plate 38 (FIGS. 1 and 10). Each of these locks has a generally L-shaped configuration and an elongated slot 70 (FIG. 1) extending longitudinally thereof and terminating with flared edges, as best seen in FIG. 1. Each of the slide locks 68 is adapted to be slid radially inwardly and outwardly over a pair of retaining heads 72 and 74 (FIG. 10) secured to the plate 38 and the hub 40, respectively. By pulling both of the slide locks 68 clear of the inner retaining heads 74, the outer plate 38 can be removed for replacing a spent or empty roll 32. The plate may thereafter be mounted onto the hub and both of the slide locks may be slid inwardly until they each engage the inner retaining head 74 to lock the plate 38 in position over the new roll 32.

Preferably, as shown in FIG. 10, the width of the ticket stock roll is slightly less than the distance between the inner and outer plates 36 and 38 of the reel 14. Preferably, the width of the cardboard core 34 is slightly greater than the width of the ticket stock 32. When the slide locks 68 are locked in position as shown in FIG. 10, the cardboard roll is very lightly squeezed between the plates 36 and 38 to provide a slight amount of friction which must be overcome before the roll 32 can be rotated relative to the reel 14. It is preferable to have the friction between the ticket stock roll 32 and the reel 14 result primarily from the engagement between the cardboard core and the side plates 36 and 38 since this can be uniformly achieved as the rolls are replaced. To have the drag or friction primarily determined by the engagement between the outer curved surface of the hub 40 and the inner surface of the cardboard core 34 would be undesirable. This is because the inner diameter tolerance of the cardboard cores would be such that the amount of friction would vary significantly from roll to roll. Furthermore, it would not be desirable to have the friction between the roll and the reel primarily determined by engagement between the inner surface of the plates 36 and 38 and the side edges of the ticket stock roll. This is because as the diameter of the roll got smaller, the amount of friction would likewise reduce by a proportionate amount.

Figure 5:
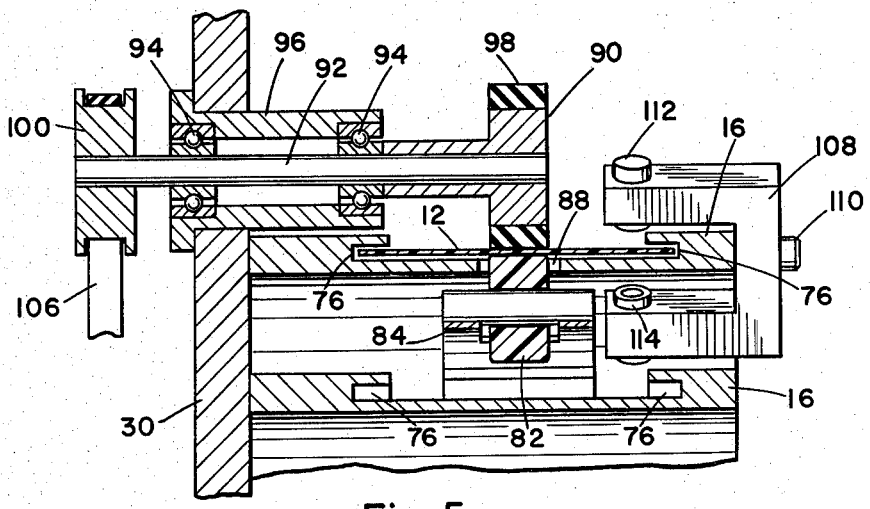
FIG. 5 is an enlarged sectional view taken along line 5—5 of FIG. 4.

Each of the ticket guide tracks 16 (FIG. 1) has a generally C-shaped cross section as best seen in FIG. 5 and defines an upwardly opening channel 76 sized for having the ticket stock 12 propelled therethrough. Each of the ticket guide tracks 16 has one side edge rigidly secured to the common support plate 30. As shown in FIG. 1, the rearward ends of the guide tracks 16 extend generally tangentially and adjacent to corresponding ones of the ticket reels 14. The forward ends of the ticket guide track 16 curve downwardly and converge at the entrance to the shear 18. Both the rearward and forward ends of each of the ticket guide tracks are open, i.e., the ticket channel 76 defined by each extends all the way through.

Figure 4:
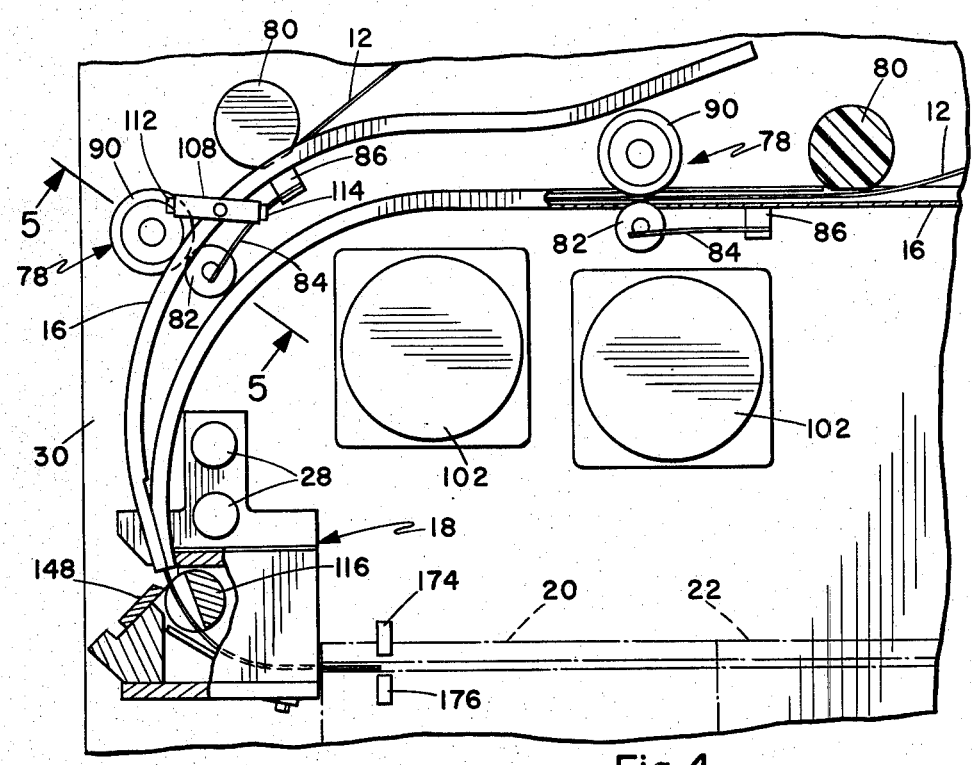
FIG. 4 is an enlarged, side elevational view of a portion of the ticket vending machine of FIG. 1, with parts broken away.

Each of the ticket guide tracks 16 is provided with a similar feed assembly 78 for positively driving ticket stock from one of the reels into the shear 18. Referring to FIG. 4, adjacent each of the assemblies 78 a portion of the ticket guide track 16 is cut away to permit the ticket stock 12 to enter the same. A cylindrical guide bar 80 extends across the top of the track 16 adjacent the point of entrance of the stock 12. As the diameter of the roll 32 decreases, the angle at which the ticket stock 12 enters the track increases. The rounded surface of the guide bar 80 provides a smooth surface for guiding the stock into the track as the angle of attack changes.

As shown in FIG. 5, a pressure roller 82 made of a suitable elastomeric material is rotatably mounted at the end of a leaf spring 84 (FIG. 4). The other end of the leaf spring is attached to a block 86 rigidly mounted to the other guide of the track 16. The pressure roller 82 extends through an aperture 88 (FIG. 5) and engages the underside of the ticket stock 12.

Continuing with the description of the construction of each of the identical feed assemblies 78, a drive roller 90 (FIG. 5) is mounted on one end of an axle 92. The other end of the axle is rotatably journaled in bearings 94 carried by a bushing 96 rigidly secured in a hole in the common support plate 30. The drive roller 90 includes an elastomeric annular cushion 98 which engages the upper side of the ticket stock 12 and propels the same. It will be understood that the leaf spring 84 (FIG. 4) urges the pressure roller 82 upwardly against the ticket stock so that the stock is squeezed between the pressure and drive roller to insure positive, non-slip feeding.

Figure 2:
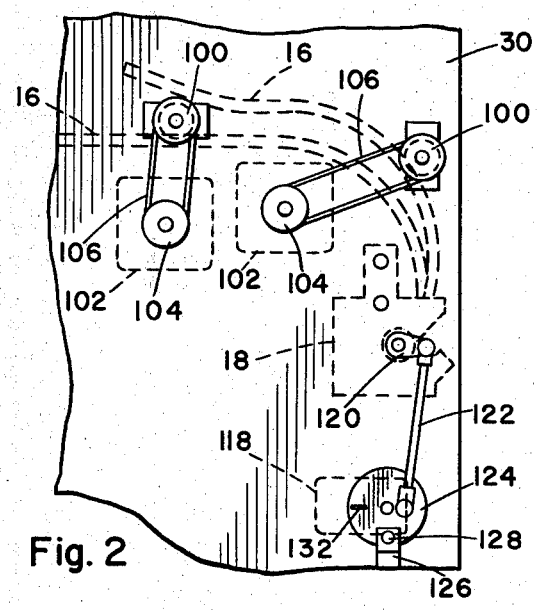
FIG. 2 is an enlarged, side elevational view of a portion of the opposite side of the ticket vending machine of FIG. 1, showing various drive connections.

The other end of the axle 92 (FIG. 5) has a pulley 100 rigidly mounted thereon. An AC motor 102 (FIG. 1) is mounted on one side of the common support plate 30 and has its shaft extending through an aperture in the plate. A pulley 104 (FIG. 2) is mounted on the shaft of the motor. A belt 106 is entrained about the pulleys 100 and 104 for providing a driving connection between the motor 102 and the drive roller 90 so that the motor can propel the ticket stock 102 through the ticket guide track 16. Preferably the pulleys are toothed and the belt is a timing belt so that a positive, non-slip drive is provided.

Each of the feed assemblies 78 (FIG. 1) further includes a U-shaped bracket 108 (FIG. 5) mounted to the outer edge of the track 16 by a screw 110. The legs of the bracket 108 extend over the ticket stock 12. A photodiode 112 emits a beam of light which, in the absence of any ticket stock in the region adjacent bracket 108, shines through a hole in the ticket guide track 16 and is detected by a photosensor 114 mounted in the other leg of the bracket. The photodiode 112 and the photosensor 114 may be utilized for detecting the depletion of a ticket roll 32.

Figure 3:
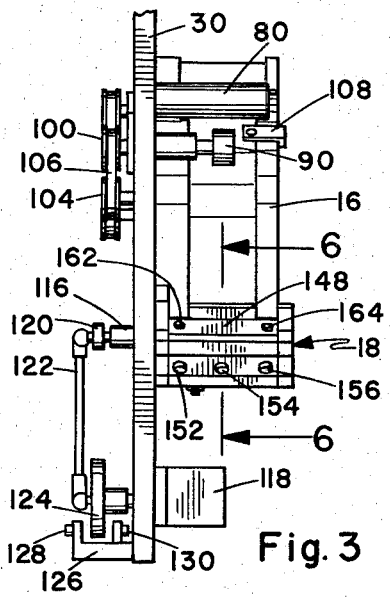
FIG. 3 is an enlarged and elevational view of a portion of the ticket vending machine of FIG. 1 taken from the left hand end of FIG. 1.

The shear 18 (FIG. 1) includes a cylindrical rotary blade 116 (FIGS. 6 and 7) and is capable of cutting the ticket stock without metal to metal contact, thereby achieving excellent service life. Shears with cylindrical rotary blades have been utilized for cutting microfilm in apparatus sold under the trademark DATAGRAPHICS. The cutting of tickets from the stock, for example credit card size tickets, is accomplished by a motor 118 (FIG. 1) operating a crank 120 (FIG. 2) connected to one end of the cylindrical blade 116 (FIG. 3) which extends through a hole in the support plate 30. A driving connection between the crank 120 and the motor 118 is provided by an arm 122 (FIGS. 2 and 3) which is pivotally connected at one end to the crank and at its other end to an eccentric 124 rigidly connected to the end of the shaft of the motor 118.

Preferably, the throw of the arm 122 (FIG. 2) is such that during one revolution of the eccentric 124 the rotary blade 116 reciprocates through an angle just large enough so that a ticket will be cut from the stock. This may be accomplished by choosing the appropriate length for the crank 120 and by attaching the arm 122 to the eccentric 124 at a suitable position. In the preferred embodiment of the shear, the eccentric rotates through one revolution in order to cut a ticket from the stock. This rotation of the eccentric causes the rotary blade 116 of the shear to rotate through approximately 50 degrees in one direction and then to rotate back through 50 degrees to its original position. Preferably, the motor 118 is an AC motor of the shaded pole type and includes an automatic brake which is disengaged by the energized stator coils and thereafter engaged to stop revolution of the eccentric upon the de-energization of the motor. This prevents the rotary blade from coasting.

A U-shaped bracket 126 (FIG. 3) is mounted to the lower portion of the support plate 30 so that its legs extend vertically on either side of the eccentric 124. A photodiode 128 is mounted on one leg of the bracket 126 and a photosensor 130 is mounted on the other leg of the bracket so that a slot 132 (FIG. 2) on the eccentric will permit the photosensor to detect light from the photodiode to indicate the completion of a single revolution of the eccentric. Signals from the photosensor 130 are sent to the local control microprocessor so that it can actuate the motor 118 to cause a single ticket to be cut.

Figure 6:
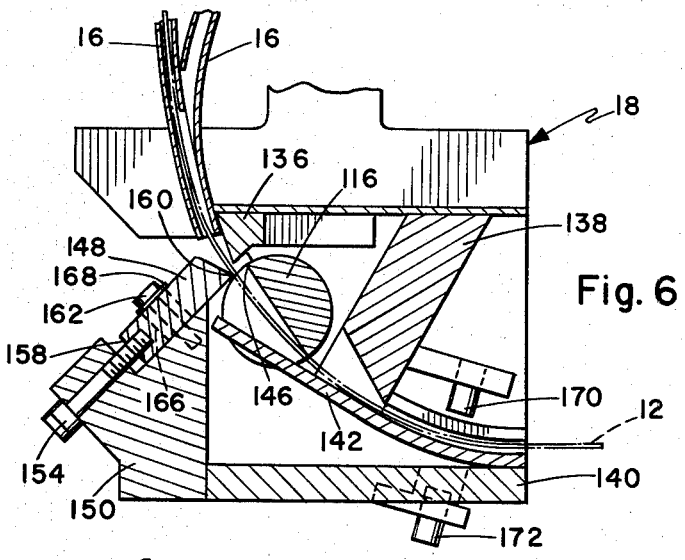
FIG. 6 is an enlarged, vertical sectional view of the shear incorporated in the ticket vending machine of FIG. 1 taken along line 6—6 of FIG. 3.

The shear 18 includes a pair of spaced apart, vertical side plates 134 (FIG. 7) for housing the rotary blade 116. The side plates 134 are rigidly connected together by beams 136, 138 and 140 (FIG. 8). One of the side plates 134 of the shear is mounted to the common support plate 30 by captive screws 28 (FIG. 1). The ends of the rotary blade 116 are journaled in ball bearings (not visible) mounted in apertures in the side plates 134 of the shear 18. As shown in FIG. 6, each of the tracks 16 converge and join together at the entrance to the shear for guiding ticket stock 12 from either one of the reels 14 to a shear track 142 which guides the stock through the shear past the blade 116.

Figure 7:
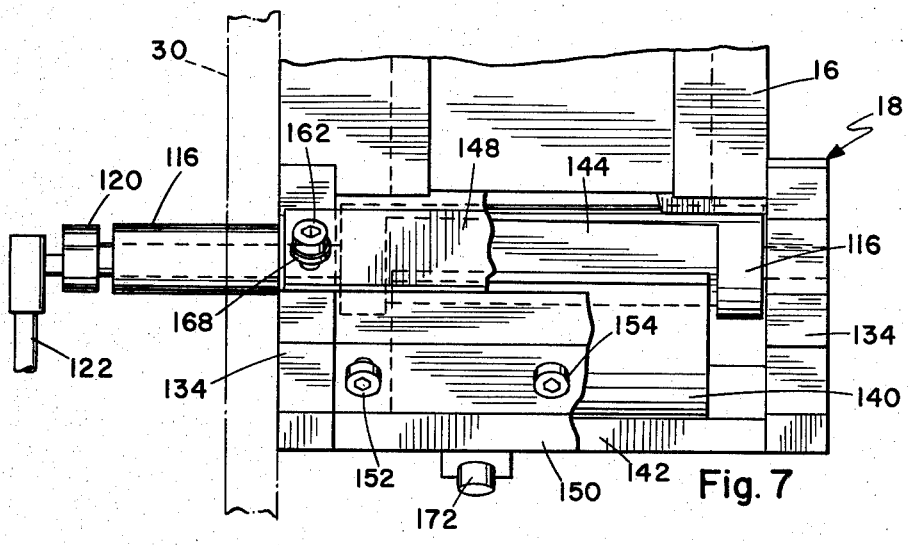
FIG. 7 is an enlarged, fragmentary view of the entry end of the shear incorporated in the ticket vending machine of FIG. 1.
Figure 8:
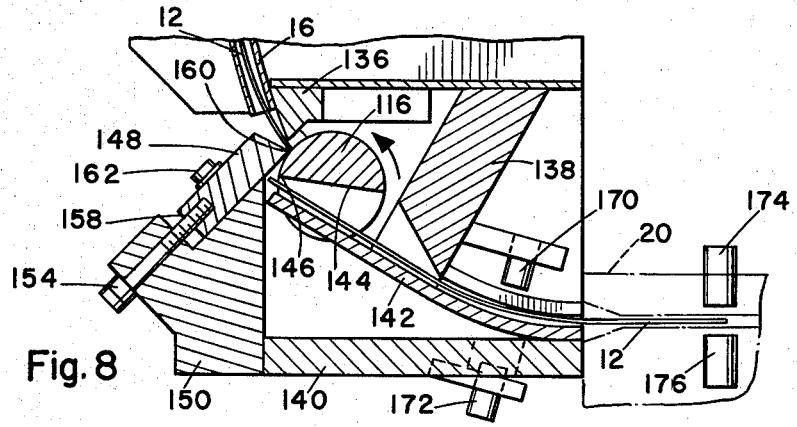
FIG. 8 is an enlarged, vertical sectional view similar to FIG. 6 illustrating the cutting action of the rotary blade in the shear.

As best seen in FIG. 7, the cylindrical rotary blade 116 has a large recess 144 in its intermediate section which has a length slightly larger than the width of the ticket stock 12. This recess extends to approximately the diameter of the intermediate portion of the blade 116. The blade cuts the ticket progressively with a shear angle of approximately 3 degrees. In other words, the flat surface defining a portion of the recess 144 extends slightly helically so that the side edge 146 of the recess which does the cutting extends at an angle of approximately 3 degrees with respect to the central axis of the blade 116.

A fixed straight shear blade 148 (FIGS. 3, 6 and 7) is mounted at an inclined angle on a support member 150 (FIG. 6). Three screws 152, 154 and 156 (FIGS. 1 and 7) secure the blade 148 to the support member 150. Two of these screws push the blade and one pulls the blade. More specifically, the screws 152 and 156 have their ends abutted against the lower edge surface 158 (FIG. 8) of the blade 148 (this is not visible in the drawings). The center screw 154 has its end threadedly engaged with a hole in the blade 148 as shown in FIG. 8. It will thus be understood that by adjusting the screws 152, 154 and 156 the proximity of the cutting edge 160 of the fixed blade 148 to the cutting edge 146 of the rotary blade 116 may be finely adjusted. The manner in which rotation of the cylindrical blade 116 cuts the stock 12 is illustrated in sequence in FIGS. 6 and 8.

The fixed shear blade 148 (FIG. 8) is also secured to the support member 150 by a pair of screws 162 and 164 (FIGS. 3 and 6) which extend perpendicular to the screws 152, 154 and 156. Each of the screws 162 and 164 extends through a hole such as 166 (FIG. 6) which has a larger diameter than the outside diameter of the shank of the screw. A spring washer 168 (FIG. 7) is positioned between the head of each of the screws 162 and 164 and the upper surface of the fixed blade 148. Thus, the fixed blade 148 has a slight bit of resilient play in the direction of the axes of the screws 162 and 164. The foregoing arrangement of push pull screws 152, 154 and 156, and spring biased clamping screws 162 and 164 permits fine adjustment in the gap between the cutting edge 160 of the fixed blade and the cutting edge 146 (FIG. 8) of the rotary blade. By way of example, for ticket stock thicknesses of approximately 0.007 to approximately 0.020 inches, a gap of about 0.001 inches will enable the shear to make a smooth progressive cut across the stock.

The shear 18 is further provided with a photodiode 170 and a photosensor 172 (FIG. 5) which are positioned in alignment with a hole in the shear track 142 for enabling the detection of the presence of a ticket. The thermal printer module 20 is similarly provided with a photodiode 174 and a photosensor 176 (FIG. 8) which enable the detection of the leading edge of a ticket in the printer module. The photosensors 172 and 176 may be utilized for checking to see that the ticket has been cut to proper length. They may be further utilized for activating the thermal printer module 120 so that it is ready to print the alphanumeric information on the ticket when it passes under the print head in that module. A more detailed discussion of the purposes of the various sensors which have been described herein can be found in the co-pending U.S. patent application entitled "Modularized Ticket Handling System For Use in Automatic Ticket Preparation System" which is being filed on even data herewith and which has already been identified above. The disclosure of that application is specifically incorporated herein by reference. It will be understood that control of the shear is accomplished by use of the photosensors described above past which the stock and the ticket pass at different stations during the feeding and shear sequence. After the ticket is cut from the stock, it is driven out of the shear by drive rollers in the printer module 20.

The local control microprocessor of the vending machine utilizes microprograms for controlling the various modules and components described herein. The programs can be written so that the ticket stock feed and shear system automatically switches from an empty roll to a full roll. Furthermore, the programs can be written to enable selective feed from either roll on demand. This will permit paper tickets to be cut from one roll and plastic tickets to be cut from the other roll. Likewise, the program can be written to enable the ticket length to be varied by taking into account the speeds of the various motors and by utilizing the sensors to indicate stock position during the sequence. The specially designed reels 13 prevent ticket stock from inadvertently unwinding due to vibrations normally encountered in a mass transit station. The construction of the reels also permits rapid replacement of spent rolls.

Figure 9:
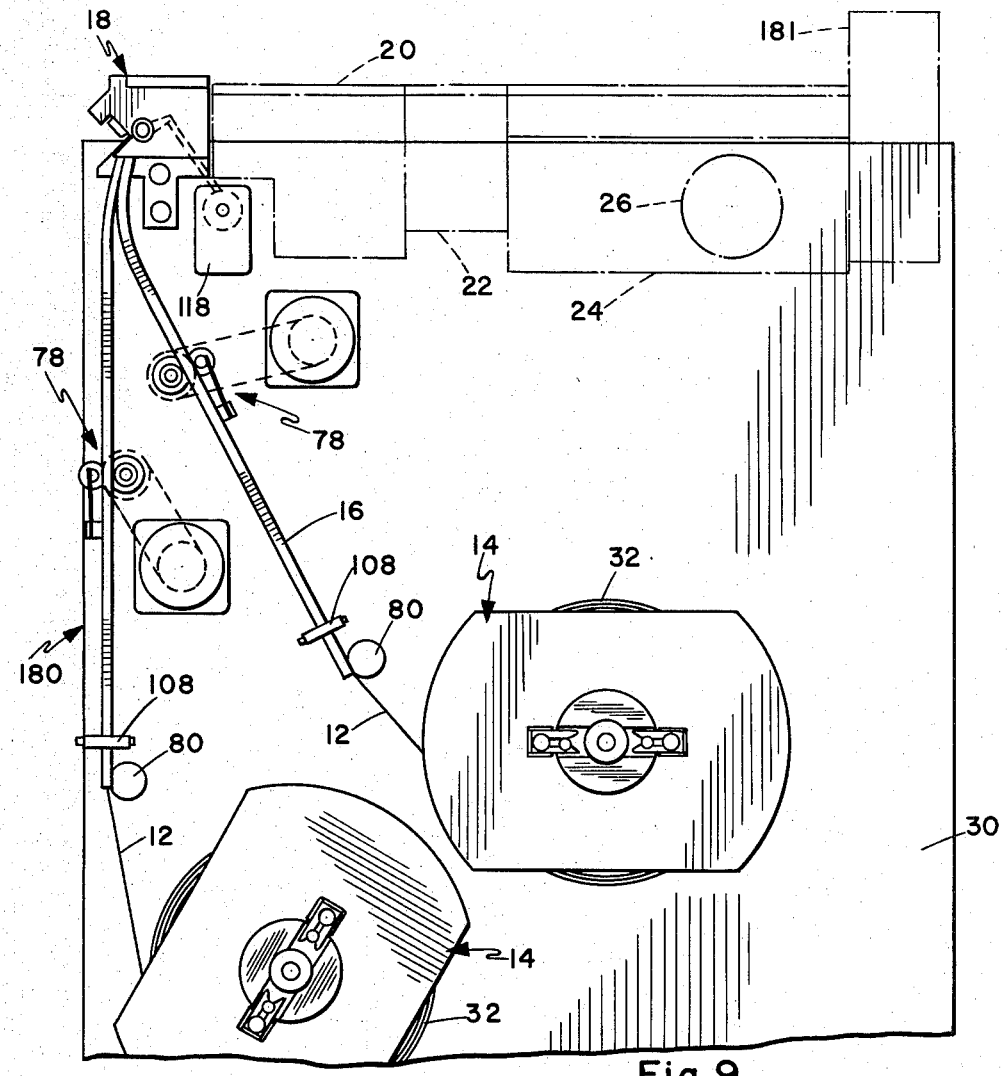
FIG. 9 is a side elevational view of a ticket vending machine incorporating a second embodiment of the ticket stock feed and shear system of the present invention.

Referring to FIG. 9, there is illustrated therein in simplified form another automatic ticket vending machine 180 which incorporates a second embodiment of the ticket stock feed and shear system of the present invention. The construction of the ticket vending machine 180 is similar to that of the ticket vending machine 10 (FIG. 1) except that in the former the ticket reels 14, the guide tracks 16 and the feed assemblies 78 are mounted below the cutting, printing and transport components. The ticket vending machine 180 also includes a ticket diverter module 181 which communicates with the rearward or exit end of the transport 24. The construction and operation of the diverter module 181 are described in the co-pending U.S. patent application entitled "Ticket Diverter Module" being filed on even date herewith which has been identified above.

Figure 11:
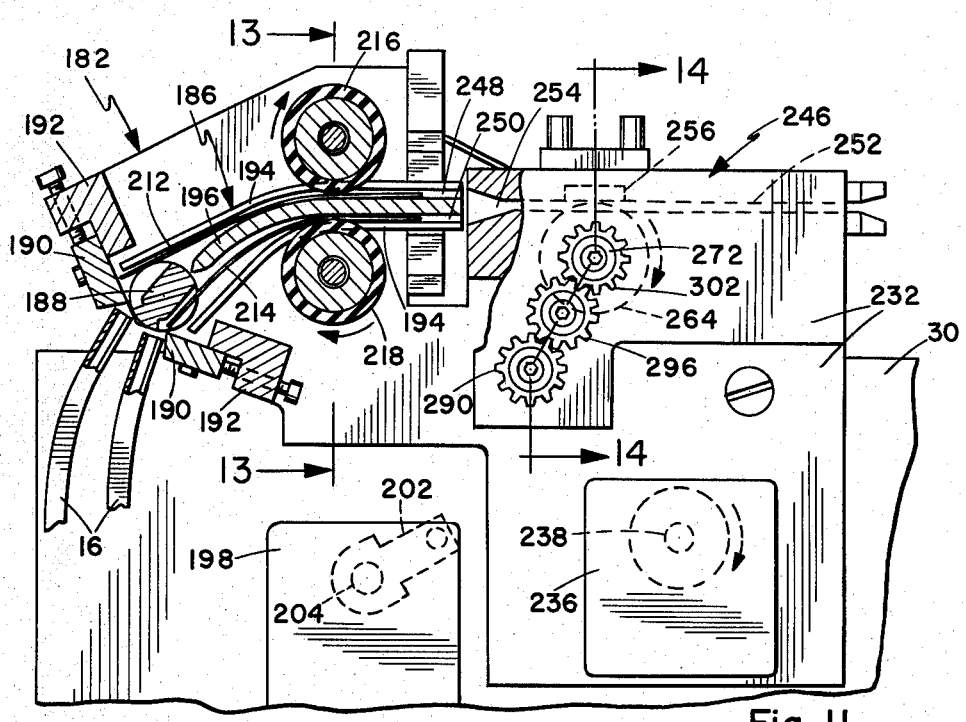
FIG. 11 is an enlarged, side elevational view, with parts broken away, of the combined shear and printer incorporated in the ticket vending machine of FIG. 9.

FIG. 11 illustrates a combined shear and printer assembly 182. It may be substituted for the shear 18 and printer module 20 in either of the vending machines 10 or 180 illustrated in FIGS. 1 and 9, respectively. Such a modified ticket vending machine will pre-cut paper or plastic tickets and hold them in escrow, and will deliver either type of ticket immediately on demand. Thereafter, it will cut a replacement ticket and move it into escrow in order to eliminate delays in the ticket vending process which would otherwise result from the time required to feed stock to the shear. The guide tracks 16 converge and direct ticket stock from corresponding ones of the reels 14 into a dual shear track assembly 186 past opposite sides of a two-way cylindrical rotary blade 188. A pair of fixed shear blades 190 are mounted on opposite sides of the rotary blade 188 so that they extend tangentially to the rotary blade with their cutting edges closely adjacent to corresponding ones of the pair of cutting edges of the rotary blade. The fixed blades 190 are adjustably held to cross members 192 with push and pull screws and spring biased retaining screws in the same fashion that the fixed shear blade 148 is mounted in the shear 18 of the first embodiment. It will be understood that each of the cutting edges of the rotary blade 188 is appropriately angled, for example 3 degrees, with respect to the central axis of the rotary blade. This enables ticket stock to be progressively cut by the edges upon appropriate rotation of the two-way blade 188.

The dual shear track assembly 188 has a pair of outer walls 194 which converge in a direction moving away from the rotary blade 188 and direct cut tickets in a generally horizontal direction. A divider 196 extends between the walls 194 of the dual shear track assembly 186 to define separate channels for tickets cut from stock fed from different ones of the reels 14.

A motor 198 (FIGS. 11 and 12) is provided for actuating the two-way rotary blade 188 of the assembly 182 for selectively cutting stock fed from either of the guide tracks 16. A crank 200 (FIG. 12) rigidly secured to one end of the rotary blade 188 and a crank 202 rigidly secured to the shaft 204 of the motor 198 are pivotally connected to opposite ends of a linkage arm 206. The ends of the arm 206 are threaded to permit adjustments in the positions of pivotal connectors 208 which are screwed onto opposite ends of the arm 206. The positions of the connectors 208 are locked by nuts 210.

Figure 12:
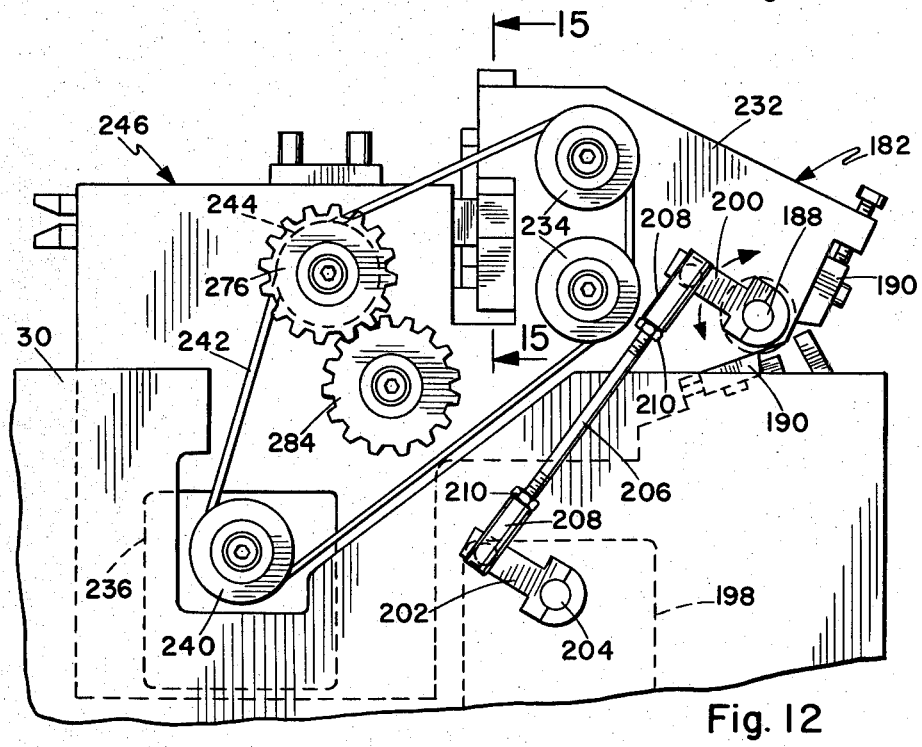
FIG. 12 is a side elevational view of the opposite side of the structure of FIG. 11.

The motor 198 (FIG. 11) is preferably a reversible AC motor which can be selectively energized to cause reciprocating angular motion of the rotary blade 188 as indicated by the arrows in FIG. 12. It will be understood that such partial rotation of the blade 188 will cause ticket stock which has been fed into the shear track assembly 186 to be cut to produce tickets such as 212 and 214.

Figure 13:
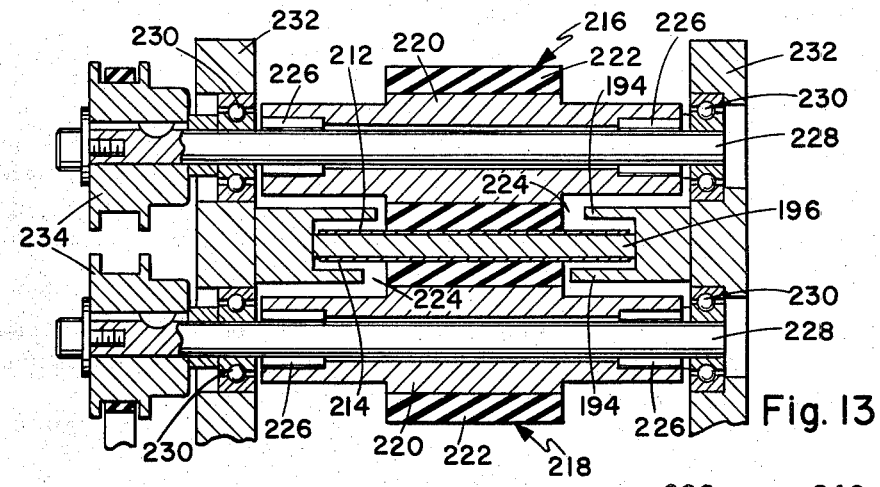
FIG. 13 is an enlarged, vertical sectional view taken along line 13—13 of FIG. 11.

A pair of upper and lower drive rollers 126 and 218 are mounted on opposite sides of the dual shear track assembly 186 for engaging and propelling tickets through either channel thereof. As shown in FIG. 13, each of the drive rollers includes a cylindrical body portion 220 made of metal and an annular cushion 222 made of a resilient elastomeric material surrounding the intermediate portion of the body portion. The cushions 222 extend through apertures 224 in the outer walls of the dual shear track assembly 186 and engage respective ones of the tickets 212 and 214. Each of the tickets is squeezed between one of the cushions 222 and the divider 196 as shown in FIG. 13 and is engaged and propelled to the right in FIG. 11.

Each body portion 220 (FIG. 13) has one-way needle bearings 226 secured in recesses in the opposite ends thereof. Axles 228 extend axially through each of the drive rollers, and through the needle bearings 226 at their opposite ends. The opposite ends of the axles 228 are journaled in ball bearings 230 rigidly secured in holes formed in the side plates 232 of the combined shear and printer assembly 183. Pulleys 234 are rigidly mounted to the ends of the axles 228. A reversible AC motor 236 (FIG. 11) is rigidly mounted to one of the side plates 232. The shaft 238 of the motor extends through holes in the plates 232 and 30 and has a pulley 240 rigidly mounted on the end thereof as shown in FIG. 12. An endless belt 242 is entrained about the pulleys 234 and 240 and about another pulley 244 to provide a positive driving connection between the motor 236 and the drive rollers 216 and 218.

The one-way needle bearings 226 (FIG. 13) on the axle 228 which extends through the upper drive roller 216 are preferably oriented in a reverse manner to the needle bearings 226 mounted on the axle 228 of the lower drive roller 218. This is done so that counter-clockwise rotation of the motor shaft 238 (referring to FIG. 11) will produce counter-clockwise rotation of the upper drive roller 216 as indicated by the arrow in FIG. 11 and so that the lower drive roller 218 will not rotate at all. Thus, counter-clockwise rotation of the motor shaft 238 will cause the upper ticket 212 to be ejected to the right into the printer portion 246 of the assembly 182. When the motor shaft 238 rotates in a clockwise direction, the upper drive roller 216 will not rotate and the lower drive roller 218 will rotate in a clockwise direction as indicated by the arrow in FIG. 11 to eject the lower ticket 214 into the printer portion 246. The needle bearings 226 of this type are sometimes referred to as Sprague-type clutches and are available commercially from companies such as Torrington Manufacturing.

The channels 248 and 250 (FIG. 11) of the dual shear track assembly 186 open into a ticket channel 252 in the printer portion 256. The entrance end of the ticket channel 252 is flared at 254 to facilitate the guiding of tickets from either one of the channels 248 or 250 into the channel 252 in a smooth fashion without jamming. The printer portion 246 includes a thermal print head 256 (FIG. 14) mounted to the underside of a door 258 hingedly mounted in an opening 260 formed in the top plate 262 of the printer section.

The print head 256 (FIGS. 11 and 14) is preferably of the type which is adapted for thermally printing alphanumeric information onto a thermally sensitive coating on the ticket as the ticket is propelled beneath the same. The underside of the print head has a plurality of print elements arranged in a row which traverses the path of travel of the ticket. The print elements comprise thick film deposited resistors through which current is passed in pulses to heat the coating of thermally sensitive material on the ticket to the threshold temperature at which it changes color, thereby causing dots to be printed on the ticket. One suitable print head is model number 01127-5G1,80021D manufactured by Gulton Industries located in New Jersey, in the United States of America. The print head is electrically connected to a printer circuit (not shown) specially adapted for maximizing printing speed by controlling the temperature of the print element in accordance with the varying dot pattern being printed.

Thus, a ticket may be rapidly propelled through the printer portion 246 (FIG. 11), for example at a speed of 3 inches per second, while multiple lines of alphanumeric information are printed on the ticket indicating the type of ticket, the amount of fare, etc. The information is printed in dot matrix form, in column by column fashion. A more detailed description of features of the printer portion 246 and the special printer circuit are set forth in the co-pending U.S. patent application entitled "Thermal Printing System" which is being filed on even date herewith and which has been referenced above. Where necessary, the disclosure of that application is specifically incorporated herein by reference.

Figure 14:
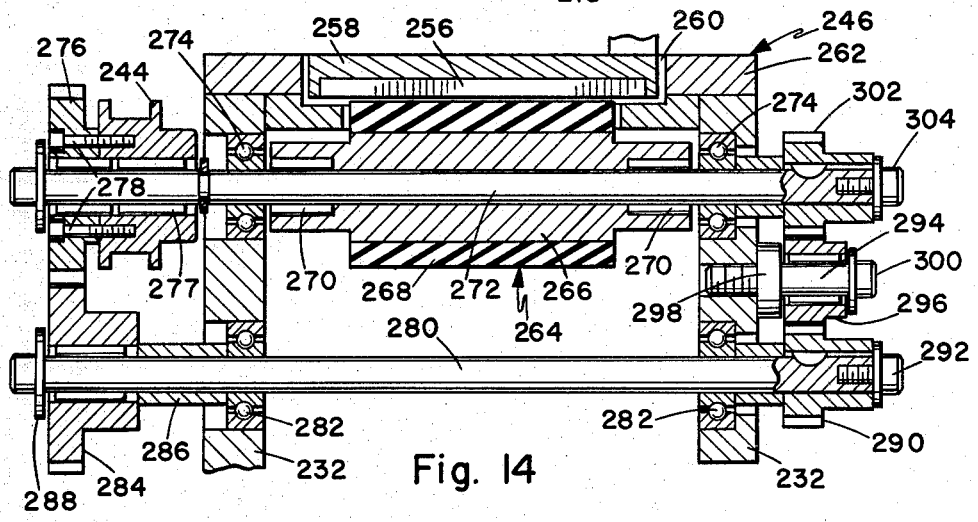
FIG. 14 is an enlarged sectional view taken along line 14—14 of FIG. 11.

The printer portion 246 further includes a printer drive roller 264 (FIGS. 11 and 14). A special drive train operatively couples the printer drive roller 264 with the motor 236 (FIG. 12) so that the printer drive roller is always driven in a clockwise direction in FIG. 11 no matter which way the shaft 238 of the motor turns. Thus, any ticket which is propelled into the ticket channel 258 in the printer portion by either of the drive rollers 216 or 218 in the shear section will always be propelled to the right past the print head 256.

The printer drive roller 264 (FIG. 14) includes a central cylindrical body portion 266 made of metal and an annular cushion or sleeve 268 made of a suitable resilient elastomeric material surrounding the middle of the body portion. The cushion 266 engages and propels a ticket past the head during the printing operation. A pair of one-way needle bearings 270 are mounted in recesses in the opposite ends of the body portion 266 of the printer drive roller 264. An axle 272 extends axially through a bore extending centrally through the drive roller and also extends through the needle bearings 270. The needle bearings 270 are oriented so that clockwise rotation of the axle 272 in reference to FIG. 11 will cause the needle bearings to lock onto the axle so that the drive roller is rotated clockwise as shown by the arrow in FIG. 11.

Opposite ends of the axle 272 are journaled in ball bearings 274 mounted in holes in corresponding ones of the side plates 232. The pulley 244 is mounted on one end of the axle 272 with a one-way needle bearing 277. A spur gear 276 is co-axially secured to the pulley 244 by screws 278. A return drive axle 280 extends parallel to and directly beneath the printer drive roller axle 272. The axle 280 has its opposite ends journaled in ball bearings 282 rigidly secured in holes in corresponding ones of the side plates 232. A spur gear 284 is rigidly mounted to one end of the return drive axle 280 and is held in position by a spacer 286 and an end cap 288 so that it intermeshes with the spur gear 276. A smaller spur gear 290 is rigidly mounted to the other end of the return drive axle 280 by a retaining screw 292. An idler axle 294 has one end threadedly engaged with a threaded hole in one of the side plates between the axles 272 and 280. A small idler spur gear 296 is mounted on the smooth portion of the idler axis 294 and is held in position by a spacer 298 and an end cap 300 so that it intermeshes with the spur gear 290. When the spur gear 290 rotates, it drives the idler spur gear 296 which freely rotates about the fixed idler axle 294. Another small spur gear 302 is rigidly mounted to the other end of the printer drive roller axle 272 and is held thereto by a retaining screw 304.

The foregoing drive connection permits the printer drive roller 264 to always be driven in a clockwise direction in reference to FIG. 11 no matter which direction the motor shaft 238 rotates. When the motor shaft 238 rotates in a counter-clockwise direction, it will cause the drive roller 216 to also rotate in a counter-clockwise direction to eject the upper ticket 212 into the printer portion 246. The lower drive roller 218 remains stationary at this time so that the lower ticket 214 is held in escrow. When the drive roller 216 rotates counter-clockwise to eject the upper ticket 212 to the right, the printer drive roller 264 rotates in a clockwise direction to propel the ticket past the print head 256. This may be explained as follows. When the motor shaft 238 turns in a counter-clockwise direction with reference to FIG. 11, the pulley 244 (FIG. 14) will rotate freely about the axle 272 due to the orientation of the one-way needle bearing 277. However, the rotation of the pulley 244 will be transmitted through the spur gears 276 and 284 to rotate the return drive axle 280. The return drive axle will in turn drive the axle 272 in a clockwise direction in FIG. 11 through the spur gears 290, 296 and 302 (FIG. 14). Clockwise rotation of the axle 272 will cause the needle bearings 270 to lock onto the axle 272 which in turn causes the drive roller 268 to be turned in a clockwise direction with respect to FIG. 11.

When the motor shaft 238 rotates in a clockwise direction (FIG. 11), the drive roller 218 will rotate in a clockwise direction to propel the lower ticket 214 (FIG. 11) to the right into the printer portion 246. Clockwise rotation of the motor shaft 238 will cause the pulley 244 (FIG. 14) to be driven in a direction so that its needle bearing 277 will clamp onto the axle 272, causing the printer drive roller 264 to turn in a clockwise direction with respect to FIG. 11 to propel the ticket 214 past the print head 256. In this mode of operation, the return drive axle 280 is also rotated but it merely drives the axle 272 in the same direction as it is being driven by the pulley 244. It will thus be understood that the various spur gears described in connection with FIG. 14 are chosen so that there is a one to one drive between the axle 272 and the axle 280 at each set of ends thereof.

Thus, the unique drive connections described above for the assembly 182 enable selective dispensing of the upper or lower ticket merely by reversing the motor 236. Complex clutches, brakes, extra motors, solenoids, etc. are not necessary. Reliability is thus greatly enhanced.

Figure 15:
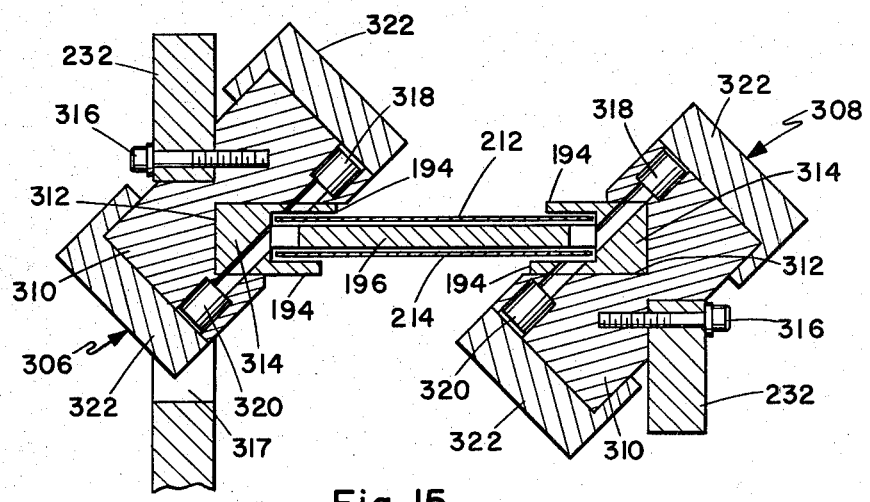
FIG. 15 is an enlarged, vertical sectional view taken along line 15—15 of FIG. 12.

FIG. 15 illustrates the manner in which a pair of photodiode/photosensor assemblies 306 and 308 are mounted just aft of the drive rollers 216 and 218 (FIG. 11). These are utilized for detecting the presence of cut tickets 212 and 214 held in escrow inside of the dual shear track assembly 186. Each of the assemblies 306 and 308 includes an inner mounting block 310 (FIG. 15) having a V-shaped recess 312 formed therein for receiving the outer corner of a corresponding one of the rectangular portions 314 which join the outer walls 194 of the dual shear track assembly 186. Each of the mounting blocks 310 is secured to a corresponding one of the side plates 232 by a screw 316. The left photodiode/-photosensor assembly 306 is mounted at an inclined angle and its lower portion extends through an aperture 317 in the side plate 232. The photodiode/photosensor assembly 308 is also mounted at an inclined angle and is secured to the top edge of the other side plate 232.

A photodiode 318 (FIG. 15) and a photosensor 320 are mounted in opposite ends of each of the blocks 310. Each of the photodiodes 318 emits a beam of light which travels through aligned holes bored in parts 310 and 194 so that the corresponding photosensor 320 can receive the light in the absence of a ticket. The assembly 306 is constructed and mounted for detecting the presence of an upper ticket 212. The assembly 308 is similarly constructed and mounted for detecting the presence of a lower ticket 214. The sensors 320 are connected to the local control microprocessor of the ticket vending machine which utilizes signals therefrom for determining whether an upper or lower ticket, or both, are in escrow ready to be dispensed on demand. End caps 322 surround the ends of the sensor blocks 310 and are removable for permitting the photodiodes and photosensors to be replaced or repaired.

The operation of the ticket vending machine such as 180 (FIG. 9) equipped with the combined shear and printer assembly 182 will now be briefly described. When the vending machine is first turned on, an initiation routine executed by the local control microprocessor first causes one of the assemblies 78 to feed stock from one of the reels 14 into the shear portion of the assembly 182. Signals from the appropriate sensors and timing information are then utilized by the local control microprocessor for energizing the motor 198 (FIG. 11) to cause the two-way rotary blade 188 to reciprocate in the appropriate directions, for example so that its cutting edge swings upwardly and then downwardly in FIG. 11. This causes the ticket stock which has been fed into the shear portion of the assembly 182 to be cut into the ticket 212 for example. Thereafter, ticket stock from the other reel is fed into the shear portion of the assembly 182 and the other ticket 214 is cut off. These tickets then remain in escrow, i.e., they are held by corresponding ones of the drive rollers 216 and 218.

When a purchaser activates the machine to purchase a ticket, depending upon which type of ticket is purchased, the local control microprocessor energizes the motor 236 (FIG. 11) so that it rotates in the appropriate direction to cause the appropriate drive roller 216 or 218 to eject the upper or lower ticket to the right into the printer portion 246. As previously explained, the other one of the drive rollers 216 or 218 remain stationary so that the other ticket remains in escrow. At the same time, the printer drive roller 264 rotates clockwise in FIG. 11 (no matter which way the motor 236 has been energized) to convey the ticket underneath the print head 256 while alphanumeric information is printed thereon. The ticket is then conveyed to the right in FIG. 9, through the static diverter module 22 and into the ticket transport 24. The ticket is then reciprocated back and forth past a single magnetic head in the transport to read, write and verify information representative of the fare or fares which have been purchased by the patron. Assuming the ticket passes the verification step, the ticket is driven through the diverter module 181 out of the vending machine for receipt by the patron.

The local control microprocessor of the vending machine then causes stock to be fed from the appropriate one of the reels so that a replacement ticket can be cut and held in escrow to replace the ticket which has just been issued to the patron. The ticket vending machine is now ready for the next patron. By cutting and holding a pair of tickets in escrow, when a patron operates the ticket vending machine, the ticket can be rapidly conveyed through the printer, through the static diverter and transport modules to the patron. The patron is thus not kept waiting during the time period that would otherwise be required for feeding and cutting of a ticket if a ticket was not already in escrow.

Having described preferred embodiments of the ticket stock feed and shear system, it should be apparent to those skilled in the art that my invention can be modified in arrangement and detail. Therefore, the protection afforded my invention should be limited only in accordance with the scope of the following claims.

I claim:

1. A system for cutting tickets from rolls of stock comprising:

a pair of reels each for carrying a roll of stock having a free end, and each including means for releasably clamping a core portion of the roll;

means for rotatably supporting each of the reels including means for providing a reverse rotational bias on each of the reels in a direction opposite to the direction of rotation required to unwind stock from the roll carried thereby;

a shear including a rotary blade and an opposing fixed blade defining a path therebetween for stock, the rotary blade cutting the stock upon rotation thereof without contacting the fixed blade;

first sensor means for detecting the presence of stock in the shear path;

a pair of ticket guide tracks each for directing the free end of the rolls from the reel carrying the roll to the path of the shear;

second sensor means for detecting the presence of stock along each of the guide tracks;

feed means for engaging and selectively propelling the free ends of the rolls along corresponding ones of the guide tracks through the path of the shear;

drive means for rotating the rotary blade to cut a portion representing a ticket from stock fed from either of the rolls; and third sensor means for sensing the amount of rotation of the rotary blade to detect the completion of the cutting of a ticket.

2. A system according to claim 1 and further comprising:

a second fixed blade opposing the rotary blade defining a second path therebetween for stock;

the ticket guide tracks being configured to direct stock from the rolls through respective ones of the paths past the rotary blade;

means for defining a pair of upper and lower channels aft of the rotary blade for receiving tickets cut from stock directed through corresponding ones of the paths;

an upper drive roller for engaging a ticket in the upper channel and propelling it therethrough away from the rotary blade and the guide tracks;

a lower drive roller for engaging a ticket in the lower channel and propelling it therethrough away from the rotary blade and the guide tracks;

means for defining a ticket channel positioned and configured for having tickets from the upper and lower channels propelled therethrough;

a ticket drive roller for engaging and propelling a ticket through the ticket channel;

a motor having a shaft; and means for rotatably mounting the drive rollers adjacent the channels and drivingly connecting the drive rollers to the motor shaft so that energizing the motor in one direction will cause a ticket in the upper channel to be propelled into and through the ticket channel while a ticket in the lower channel remains stationary, and so that energizing the motor in the other direction will cause a ticket in the lower channel to be propelled into and through the ticket channel while a ticket in the upper channel remains stationary.

* * * * *